United States Patent [19]

Bahov et al.

[11] Patent Number: 4,689,948

[45] Date of Patent: Sep. 1, 1987

[54] VORTEX AIR NOZZLE FOR YARN SPINNING FROM STAPLE FIBERS

[75] Inventors: Dinko A. Bahov, Gabrovo; Hristo A. Bahov, Stara Zagora, both of Bulgaria

[73] Assignee: NPK "Textilno Maschinostroene", Gabrovo, Bulgaria

[21] Appl. No.: 861,496

[22] Filed: May 9, 1986

[51] Int. Cl.[4] ..... D01H 5/28; D01H 7/92; D02G 1/04

[52] U.S. Cl. ..... 57/328; 57/333; 57/350

[58] Field of Search ..... 57/328, 333, 350

[56] References Cited

U.S. PATENT DOCUMENTS

| | | | |
|---|---|---|---|
| 4,434,611 | 3/1984 | Hasegawa et al. | 57/328 |
| 4,437,302 | 3/1984 | Anahara et al. | 57/333 |
| 4,476,672 | 10/1984 | Anahara et al. | 57/333 |
| 4,489,545 | 12/1984 | Susumu et al. | 57/328 X |

*Primary Examiner*—John Petrakes

*Attorney, Agent, or Firm*—Karl F. Ross; Herbert Dubno

[57] ABSTRACT

The present invention relates to a vortex air nozzle for yarn spinning from staple fibers, comprising an outgoing pair of drawing rollers, next to which is located an inlet chamber for the formation of free tails of fibers, with decreasing flat cross-section and inner grooved channels, ending with a cylindrical part, connected to the outgoing twisting chamber, supplied with tangential channels for air feeding, wherein in the inlet chamber for the formation of the free tails of fibers. The grooved channels are laterally formed in a drawing plane and reach the cylindrical outgoing part, as in the inlet chamber enters part of the circumferential surface of the lower drawing roller, as the cylindrical outgoing part is enveloped by the outgoing twisting chamber, which tangential openings are concentrically formed above the said cylindrical outlet part. The advantages of the present invention are that a sufficiently large number of free tails is created, and a control is ensured, up to the achievement of the false twist, and the fibers are strongly twisted by a potential vortex.

3 Claims, 4 Drawing Figures

VORTEX AIR NOZZLE FOR YARN SPINNING FROM STAPLE FIBERS

FIELD OF THE INVENTION

The invention relates to a vortex air nozzle for yarn spinning from staple fibers, finding application in the textile industry and mainly for yarn production for various kinds of textile—fabrics, knitted goods, industrial textiles, etc.

BACKGROUND OF THE INVENTION

A vortex air nozzle is known for yarn spinning from staple fibers, comprising an inlet chamber for the formation of free tails of the fibers, the chamber being connected to tangential channels for compressed air supply. Close to an outlet pair of drafting rollers approximately intersecting the drawing line of the roving is placed a deflection roller. Part of the circumferential surface of that roller lies in the inlet chamber for the formation of fibers free tails (EP DO No. 57876).

A disadvantage of this nozzle is that because of the direct compressed air feeding in the outlet twisting chamber, the axial component is not sufficient to ensure a reliable transport of the roving and its reliable passage through the narrowed outlet of the inlet chamber in the formation of the fibers free tails. A vortex air nozzle (German patent document No. 32 46 146) is known for yarn spinning from staple fibers, which comprises an inlet chamber for fibers free tail formation and an outlet chamber for twisting. The wider part of that section is a parallel to the drawing line, and there are grooved channels in the chamber for avoiding the rotation of the roving when the false twist is imparted for the formation of the free tails. At its end, the inlet chamber takes a cylindrical form, and is connected to the outlet twisting chamber. The outlet chamber wall are formed with tangential channels for compressed air feed. The tangential channels are inclined toward the end of the inlet chamber. The above mentioned inlet and outlet chambers are formed as a common body of the vortex air nozzle, which is placed close to the outlet pair of drawing rollers.

The disadvantage of this nozzle is that the torque moment, imparted in the outlet twisting chamber is only partially delivered despite the abovementioned grooved channels. The twist possible at the infeed of the roving the inlet chamber for the formation for the formation of free tails makes the formation of the free tails of the fibers difficult. Another disadvantage of the said nozzle is that the compressed air is directly fed to the outgoing twisting chamber. The said air flux is inclined towards the movement of the fibrous ribbon, promoting the transport of the ribbon and its free movement through the narrow cylindrical part of the inlet chamber for the formation of free tails of fibers. But the axial component of the air flow is not sufficient to ensure a reliable transport of the roving, and the roving has fiber free tails.

OBJECT OF THE INVENTION

The object of the present invention is to provide a vortex air nozzle for yarn spinning from staple fibers, by creating large numbers of free tails of fibers keeping their free positions up to their entry into the outgoing twisting chamber.

SUMMARY OF THE INVENTION

The object is attained by the creation of a vortex air nozzle for yarn spinning from staple fibers, comprising an outgoing pair of drawing rollers, next to which is located an inlet chamber for the formation of fiberfree tails, having a decreasing flat cross-section and inner grooved channels, ending with a cylindrical part, connected to an outgoing twisting chamber with tangential openings for air feed. According to the invention, there are side grooved channels in the inlet chamber for the formation of fiberfree tails, the channels reaching the cylindrical outgoing part, as part of the circumferential surface of the lower drawing roller goes into the inlet chamber. The cylindrical outgoing part is enveloped by the outlet twisting chamber whose tangential openings are concentric with the cylindrical outgoing part.

The advantages of the vortex air nozzle for yarn spinning from staple fibers, according to the invention, is that sufficiently large numbers of free tails are created, a control is ensured up to the point of the false twist, and the fibers are strongly twisted by a potential vortex.

BRIEF DESCRIPTION OF THE DRAWING

The invention is clarified by the accompanying drawing in which.

SPECIFIC DESCRIPTION

Figure 1:
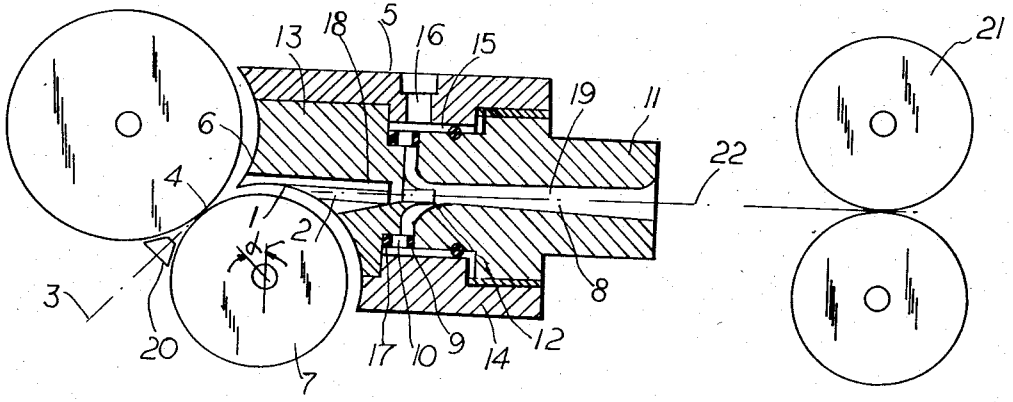
FIG. 1 is a vertical cross section through the device.
Figure 3:
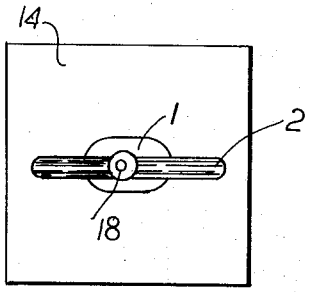
FIG. 3 is a rear view of the spinning jet.
Figure 4:
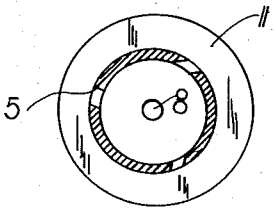
FIG. 4 is a section of the twisting orifice through the tangential openings.
Figure 2:
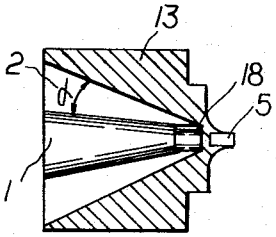
FIG. 2 is a horizontal cross section through the inlet orifice.

The vortex air nozzle for yarn spinning from staple fibers comprises an inlet chamber 1 for the formation of the free tails of fibers, in which are located laterally inner grooved channels 2, for enveloping the roving 3 from the drawing line 4 up to the cylindrical outgoing part 5. Part of the circumferential surface 6 of the lower drawing roller 7 of the outlet pair of drawing rollers projects into the inlet of chamber 1. The cylindrical outgoing part 5 is enveloped by the outlet twisting chamber 8. Tangential openings 9 are concentrically formed above the part 5 in step 10 of body 11 of the outgoing chamber 8 in the space 12, formed between the body 11 formed with the outlet chamber 8, and the body 13, where is formed the inlet chamber 1. The bodies 11 and 13 are disassembably connected between each other and to the sleeve 14. Between the latter and the body 11 of the outgoing chamber 8 a circular air space 15 is connected to opening 16 for compressed air feed. Gaskets 17 are placed at the joining points.

In the inlet chamber 1 for the formation of free fiber tails before the cylindrical outgoing part 5 is formed a cylindrical passage 18. The cylindrical outgoing part 5 enters into the space 12.

The circumferential surface 6 of the outgoing drawing roller 7 subtends an angle of 15° to 65°, and the grooved channels 2 converge in the direction of the outgoing chamber 8 with angle 8° to 28°. The outgoing chamber 8 is formed with an extension 19 with angle of divergence from 1° up to 3°. Before the pair of outgoing drawing rollers is placed a funnel 20 for guiding the roving 3, and after the air vortex nozzle for yarn spinning from staple fibers is mounted a pair of pulling out rollers 21.

The air vortex nozzle for yarn spinning from staple fibers function as follows: The roving 3 fed through the funnel 20 and drafted by the rollers 6, 7, moves together with the surface 6 of the lower drawing roller 7 and enters the inlet chamber 1 for the formation of the fiber-free tails and passes through the grooves of channels 2, as a result of the sucking created by the injection action at the front part of the cylindrical outgoing element (part) 5 of the inlet chamber 1 and the space 12 which forms the inlet of the outgoing chamber 8. Then it enters the latter, where part of it is twisted by the air vortex created in the space 12 under the action of the incoming high pressure air through the tangential openings 9. The rear free fibers from the roving 3 move in the lateral grooved channels 2, and then, together with the core fibres enter the outgoing chamber 8 for false twisting. At the moment of untwisting of the core fibres in the outgoing chamber, the free surface fibres together with the free tails of fibres are twisted round the parallel core fibres, forming the continuous smooth yarn 22, which is pulled by the pair of rollers 21.

We claim:

1. A false-twist-producing air vortex spinning nozzle, comprising:

a pair of drafting rollers including an upper roller and a lower roller having respective axes lying in a common plane inclined to a linear spinning path extending along an axis and between which a roving of staple fibers is fed;

an inlet body formed with an elongated inlet chamber extending along said axis having an inlet end receiving said roving from said rollers, said lower roller projecting into said chamber from below, opposite sides of said chamber along said path being formed with generally flat grooves receiving said roving and in which free fiber ends are formed and guided, said inlet body being formed at an outlet end opposite said inlet end with a projecting tip;

an outlet body axially adjoining at one end thereof said inlet body and formed with an elongated outlet chamber axially aligned with said tip and receiving said roving therefrom, said outlet chamber opening into an outlet diverging toward an end of said outlet body opposite said end at which said outlet body adjoins said inlet body, said bodies defining between them an annular outwardly open space surrounding said tip and opening into said outlet chamber around said tip;

a sleeve at least partly receiving said bodies and defining an annular compartment connectable with a compressed-air source; and means including a step formed on said outlet body between said compartment and said space defining passages angularly spaced about said axis, communicating between said compartment and said space and opening tangentially into said space to generate an air vortex where said space opens into said chamber to impart a false twist to said roving.

2. The spinning nozzle defined in claim 1 wherein said grooves converge away from said rollers.

3. The spinning nozzle defined in claim 2 wherein said lower roller is subtended by said housing over an arc between said substantially 15° to 65°, said grooves converge away from said rollers with a angle of 8° to 28° and said outlet diverges from said outlet chamber at an angle of 1° to 3°.

* * * * *